US011795789B1

(12) United States Patent
Batarseh

(10) Patent No.: US 11,795,789 B1
(45) Date of Patent: Oct. 24, 2023

(54) CASED PERFORATION TOOLS

(71) Applicant: SAUDI ARABIAN OIL COMPANY, Dhahran (SA)

(72) Inventor: Sameeh Issa Batarseh, Dhahran Hills (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/819,896

(22) Filed: Aug. 15, 2022

(51) Int. Cl.
*E21B 43/112* (2006.01)
*E21B 43/116* (2006.01)
*E21B 43/119* (2006.01)

(52) U.S. Cl.
CPC ..... *E21B 43/112* (2013.01); *E21B 43/116* (2013.01); *E21B 43/119* (2013.01)

(58) Field of Classification Search
CPC .... E21B 43/112; E21B 43/114; E21B 43/116; E21B 43/119; E21B 43/10
See application file for complete search history.

(56) References Cited

U.S. PATENT DOCUMENTS 2,381,929 A * 8/1945 Schlumberger ..... E21B 43/112 175/2
2,526,695 A * 10/1950 Schlumberger ..... E21B 43/112 166/55.2
2,546,669 A * 3/1951 Kirby ..... E21B 49/06 175/96
3,301,337 A * 1/1967 Vaughn ..... E21B 43/116 175/22
3,338,307 A * 8/1967 Redwine ..... E21B 49/10 166/264
3,419,089 A * 12/1968 Venghiattis ..... E21B 43/116 166/50
3,690,380 A * 9/1972 Grable ..... E21B 43/11 166/308.1
4,964,759 A * 10/1990 Guzzetta ..... F16L 55/26 405/303
5,224,556 A * 7/1993 Wilson ..... E21B 43/267 166/383
6,276,453 B1 * 8/2001 Bond ..... E21B 1/00 166/50
6,772,839 B1 * 8/2004 Bond ..... E21B 23/04 166/383
6,888,097 B2 5/2005 Batarseh
8,619,503 B2 12/2013 Radtke et al.
8,863,862 B1 * 10/2014 Parmentier ..... E21B 49/06 175/77

(Continued)

FOREIGN PATENT DOCUMENTS

DE 102006014559 A1 * 10/2006 ..... E21B 33/13

*Primary Examiner* — Daniel P Stephenson
(74) *Attorney, Agent, or Firm* — Osha Bergman Watanabe & Burton LLP

(57) ABSTRACT

A tool includes a main body with one or more segments. Each of the one or more segments includes an outer wall, an inner volume defined within the outer wall and a pre-perforated spear mounted at the outer wall. The tool also includes one or more acoustic transducers which induce sonoluminescence in the inner volume, wherein pressure resulting from the induced sonoluminescence causes the pre-perforated spear to be ejected from the outer wall. A related method includes providing such a tool, inserting it to a wellbore and ejecting it from the outer wall as noted.

20 Claims, 4 Drawing Sheets

(56) References Cited

U.S. PATENT DOCUMENTS

| | | | | |
|---|---|---|---|---|
| 9,528,874 | B2 * | 12/2016 | Larter | E21B 49/10 |
| 10,260,308 | B2 | 4/2019 | Frazier | |
| 11,028,686 | B2 | 6/2021 | Batarseh | |
| 11,255,172 | B2 | 2/2022 | Batarseh et al. | |
| 11,332,997 | B2 * | 5/2022 | Hitchcock | E21B 33/13 |
| 2008/0035349 | A1 * | 2/2008 | Richard | E21B 43/08 166/308.1 |
| 2011/0132612 | A1 * | 6/2011 | Agrawal | E21B 34/063 166/317 |
| 2014/0305877 | A1 * | 10/2014 | Cioanta | E21B 7/24 134/1 |
| 2014/0345861 | A1 | 11/2014 | Stalder et al. | |
| 2015/0198022 | A1 | 7/2015 | Stanecki et al. | |
| 2017/0204707 | A1 * | 7/2017 | Clark | E21B 43/003 |
| 2019/0071955 | A1 * | 3/2019 | Al-Anazi | E21B 43/08 |
| 2020/0325746 | A1 * | 10/2020 | Lerbrekk | E21B 33/13 |
| 2020/0392830 | A1 * | 12/2020 | Batarseh | E21B 47/18 |

* cited by examiner

CASED PERFORATION TOOLS

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore may depend on formation permeability. When formation permeability is low, stimulation is applied to enhance the flow. Stimulation can be applied around the wellbore and into the formation to build a network in the formation.

Conventionally, and toward a purpose of wellbore stimulation, a perforation gun with shaped charges and a detonator may be used. To thereby establish communication between a wellbore and surrounding formation, individual charges can be detonated such that each creates a corresponding tunnel which penetrates the wellbore casing and branches off from the wellbore into the formation. However, tunnels so created are often prone to sanding, structural deformation or even collapse. Successful remedies have yet to be developed which improve significantly on such shortcomings.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a tool including a main body with one or more segments. Each of the one or more segments includes an outer wall, an inner volume defined within the outer wall and a pre-perforated spear mounted at the outer wall. The tool also includes one or more acoustic transducers which induce sonoluminescence in the inner volume, wherein pressure resulting from the induced sonoluminescence causes the pre-perforated spear to be ejected from the outer wall.

In one aspect, embodiments disclosed herein related to a method which includes providing a tool including a main body with one or more segments. The one or more segments include an outer wall, an inner volume defined within the outer wall and a pre-perforated spear mounted at the outer wall. The tool is inserted into a wellbore, and sonoluminescence is induced in the inner volume. The pre-perforated spear is ejected from the outer wall via pressure resulting from the induced sonoluminescence.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
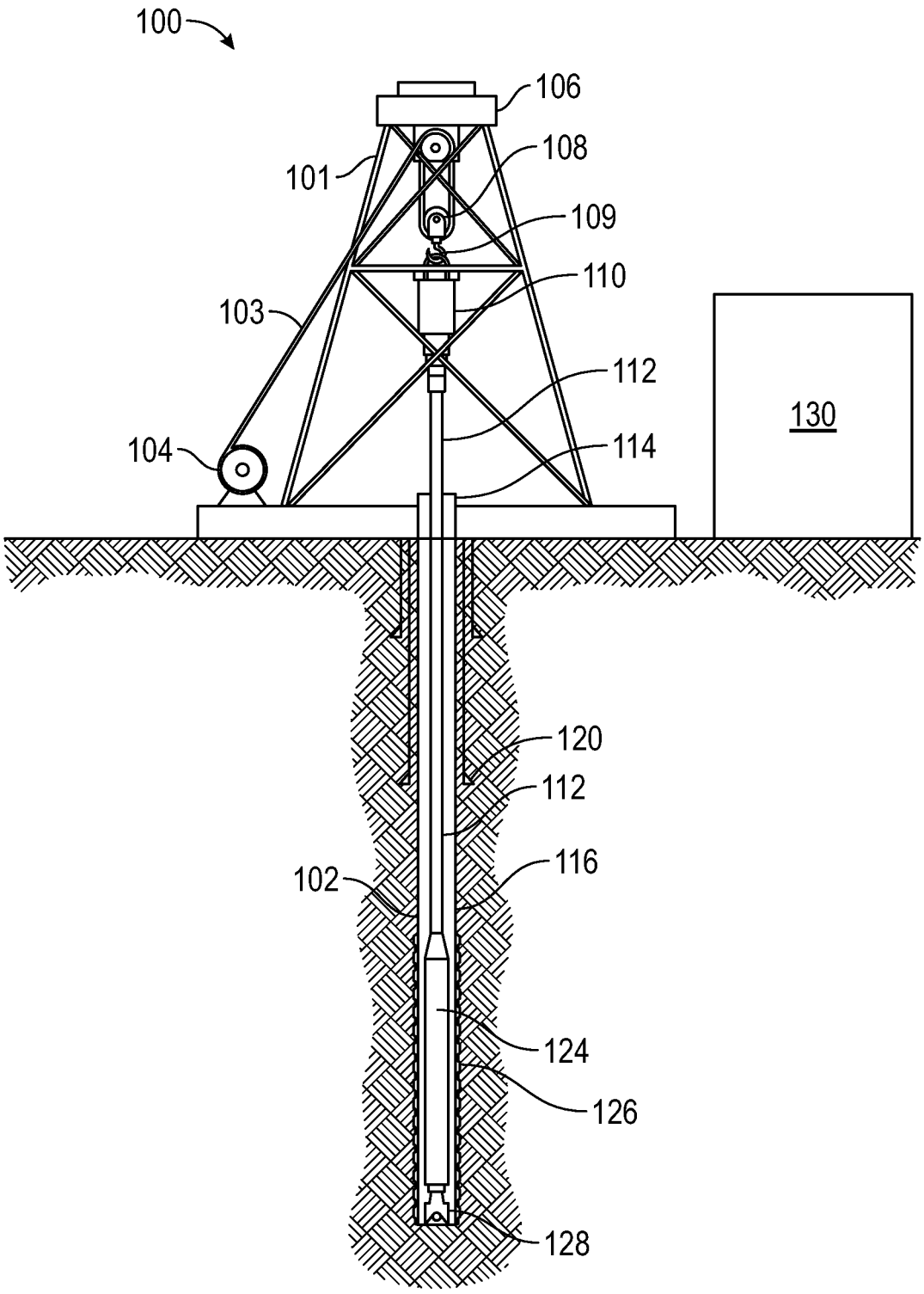
FIG. 1 schematically illustrates, in a cross-sectional elevational view, a conventional drilling rig and wellbore by way of general background and in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In accordance with one or more embodiments, there is broadly contemplated herein an arrangement for establishing communication between a subsurface wellbore and surrounding formation, via employing sonoluminescence to create sufficient pressure to drive pre-perforated spears.

Turning now to the figures, to facilitate easier reference when describing FIGS. 1 through 6, reference numerals may be advanced by a multiple of 100 in indicating a similar or analogous component or element among FIGS. 1-6.

FIG. 1 schematically illustrates, in a cross-sectional elevational view, a conventional drilling rig and wellbore by way of general background and in accordance with one or more embodiments. As such, FIG. 1 illustrates a non-restrictive example of a well site 100. The well site 100 is depicted as being on land. In other examples, the well site 100 may be offshore, and drilling may be carried out with or without use of a marine riser. A drilling operation at well site 100 may include drilling a wellbore 102 into a subsurface including various formations 126. For the purpose of drilling a new section of wellbore 102, a drill string 112 is suspended within the wellbore 102. The drill string 112 may include one or more drill pipes connected to form conduit and a bottom hole assembly (BHA) 124 disposed at the distal end of the conduit. The BHA 124 may include a drill bit 128 to cut into the subsurface rock. The BHA 124 may include measurement tools, such as a measurement-while-drilling (MWD) tool or a logging-while-drilling (LWD) tool (not shown), as well as other drilling tools that are not specifically shown but would be understood to a person skilled in the art.

Additionally, by way of general background in accordance with one or more embodiments, the drill string 112 may be suspended in wellbore 102 by a derrick structure 101. A crown block 106 may be mounted at the top of the derrick structure 101. A traveling block 108 may hang down from the crown block 106 by means of a cable or drill line 103. One end of the drill line 103 may be connected to a drawworks 104, which is a reeling device that can be used to adjust the length of the drill line 103 so that the traveling block 108 may move up or down the derrick structure 101. The traveling block 108 may include a hook 109 on which a top drive 110 is supported. The top drive 110 is coupled to the top of the drill string 112 and is operable to rotate the drill string 112. Alternatively, the drill string 112 may be rotated by means of a rotary table (not shown) on the surface 114. Drilling fluid (commonly called mud) may be pumped from a mud system 130 into the drill string 112. The mud may flow into the drill string 112 through appropriate flow paths in the top drive 110 or through a rotary swivel, if a rotary table is used (not shown).

Further, by way of general background in accordance with one or more embodiments, and during a drilling operation at the well site 100, the drill string 112 is rotated relative to the wellbore 102 and weight is applied to the drill bit 128 to enable the drill bit 128 to break rock as the drill string 112 is rotated. In some cases, the drill bit 128 may be rotated independently with a drilling motor. Generally, it is also possible to rotate the drill bit 128 using a combination of a drilling motor and the top drive 110 (or a rotary swivel if a rotary table is used instead of a top drive) to rotate the drill string 112. While cutting rock with the drill bit 128, drilling fluid or "mud" (not shown) is pumped into the drill string 112. The mud flows down the drill string 112 and exits into the bottom of the wellbore 102 through nozzles in the drill bit 128. The mud in the wellbore 102 then flows back up to the surface 114 in an annular space between the drill string 112 and the wellbore 102 carrying entrained cuttings to the surface 114. The mud with the cuttings is returned to the mud system 130 to be circulated back again into the drill string 112. Typically, the cuttings are removed from the mud, and the mud is reconditioned as necessary, before pumping the mud again into the drill string 112.

Moreover, by way of general background in accordance with one or more embodiments, drilling operations are completed upon the retrieval of the drill string 112, the BHA 124, and the drill bit 128 from the wellbore 102. In some embodiments of wellbore 102 construction, production casing operations may commence. A casing string 116, which is made up of one or more larger diameter tubulars that have a larger inner diameter than the drill string 112 but a smaller outer diameter than the wellbore 102, is lowered into the wellbore 102 on the drill string 112. Generally, the casing string 116 is designed to isolate the internal diameter of the wellbore 102 from the adjacent formation 126. Once the casing string 116 is in position, it is set and cement is typically pumped down through the internal space of the casing string 116, out of the bottom of the casing shoe 120, and into the annular space between the wellbore 102 and the outer diameter of the casing string 116. This secures the casing string 116 in place and creates the desired isolation between the wellbore 102 and the formation 126. At this point, drilling of the next section of the wellbore 102 may commence.

The disclosure now turns to working examples of a perforation tool in accordance with one or more embodiments, as described and illustrated with respect to FIGS. 2A-6. It should be understood and appreciated that these merely represent illustrative examples, and that a great variety of possible implementations are conceivable within the scope of embodiments as broadly contemplated herein.

By way of general background in accordance with one or more embodiments, perforation is a stage of well completion that takes place after drilling a main wellbore, e.g., as described and illustrated with respect to FIG. 1. The wellbore may be cased as shown in FIG. 1, or may be without a casing.

By way of additional background in accordance with one or more embodiments, when an acoustic wave travels through fluid (such as water) in the presence of gas, a bubble is formed. When the bubble collapses, it produces a very large amount of energy based on a very high pressure and temperature; this essentially is the principle of sonoluminescence.

Accordingly, in accordance with one or more embodiments, the sonoluminescence principle is employed in a perforation stage of well competition. Particularly, one or more bubbles are created as noted, in-situ in a wellbore and via a dedicated tool. The resultant energy is harvested to drive one or more pre-perforated spears into the surrounding formation toward creating cased perforation tunnels.

Figure 2A:
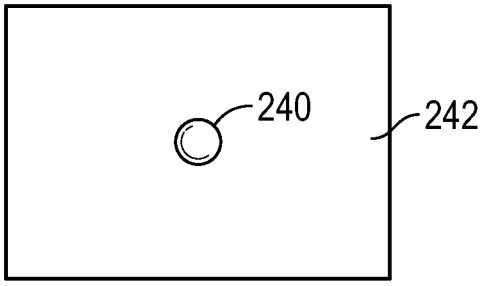
FIGS. 2A-D schematically illustrate a general principle of sonoluminescence, in accordance with one or more embodiments.

In accordance with one or more embodiments, FIGS. 2A-D schematically illustrate a general principle of sonoluminescence. FIG. 2A shows a bubble 240 in a fluid environment 242. The bubble 240 may be pre-existing or may be generated (e.g., via a known process of cavitation).

Figure 2B:
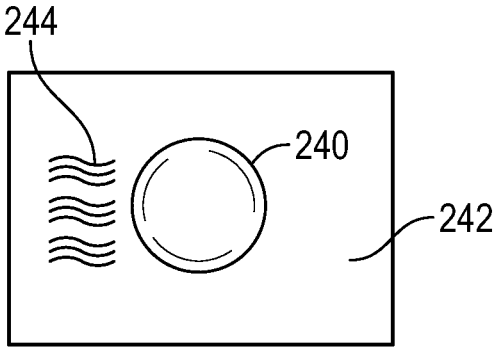
Figure 2C:
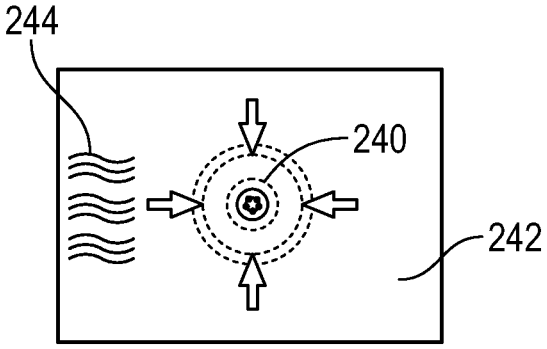
Figure 2D:
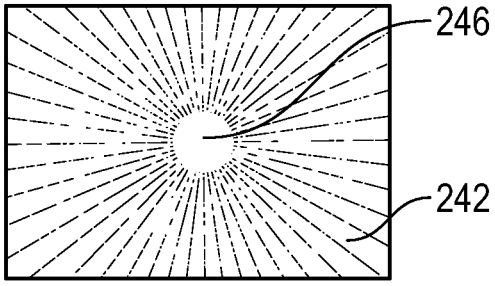

In accordance with one or more embodiments, as shown in FIG. 2B, the bubble 240 is then caused to expand upon bombardment with acoustic waves 244. Particularly, the acoustic waves 244 will be of sufficient intensity to cause expansion of the bubble 240. As shown in FIG. 2C, the expanded bubble 240 continues to be exposed to the acoustic waves 244, or is newly exposed to a new transmission of acoustic waves 244, and is caused to collapse. Then, the collapsing causes the release (246) of energy and light as shown in FIG. 2D. A significantly high pressure and temperature may then result, e.g., about 14,695 psi and 8540 degrees F. The generated pressure could be even higher if deemed suitable for the operating context at hand, via generating or expanding even more bubbles 240 or transmitting stronger acoustic waves 244. The generated pressure generally can be tailored based on a number of different factors, including the hardness or penetrability of the formation at hand (see 326 in FIG. 3). Thus, by way of illustrative and non-restrictive examples, the generated pressure could be about 350 psi for soft and shallow formations or up to about 20,000 psi for harder, deeper formations.

Figure 3:
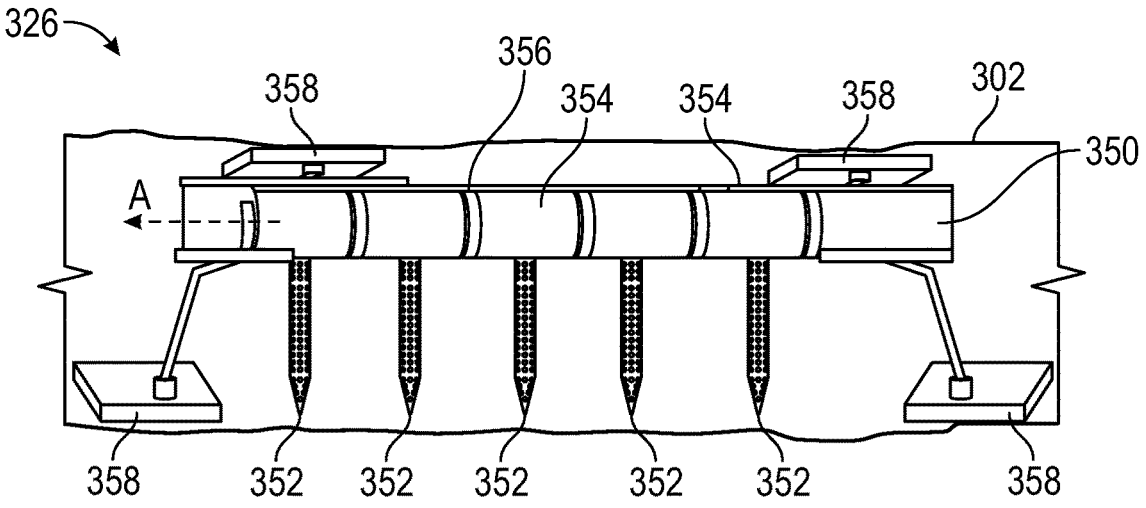
FIG. 3 schematically illustrates, in elevational view, a perforation tool in accordance with one or more embodiments.

In accordance with one or more embodiments, FIG. 3 schematically illustrates, in elevational view, a perforation tool 350. Particularly, perforation tool 350 creates acoustic bubbles and releases energy via sonoluminescence in-situ, and such energy ejects pre-perforated spears 352 into the formation 326 to create tunnels. Once ejected and driven into the formation 326, holes or perforations in the pre-perforated spears 352 will permit a flow of hydrocarbon between the formation 326 and the wellbore 302.

Accordingly, in accordance with one or more embodiments, the perforation tool 350 may include a main body (e.g., generally cylindrical in shape) and may be inserted into the wellbore 302 and positioned at a predetermined target zone downhole. The tool 350 may include a plurality of segments 354 disposed in series along a central longitudinal axis A of the tool 350; five such segments 354 are shown in FIG. 3. Each segment 354 includes one or more pre-perforated spears 352 attached thereto; in the working example shown, there is one such spear 352 per segment 354. Each segment 354 may be rotationally displaceable with respect to one or more adjacent segments 354. Thus, to this end, each segment 354 may be joined to one or more axially adjacent segments 354 via a suitable rotational joint 356.

In accordance with one or more embodiments, one or more expandable packers 358 can also be attached to the tool 350 in a manner to shift a position of the tool 350 (e.g., laterally or radially) within the wellbore 302 when activated, and thereby provide sufficient clearance between the tool 350 and inner surface of wellbore 302 to permit effective deployment of the spears 352. Four such packers 358 are shown in FIG. 3, with two pairs thereof disposed radially opposite one another with respect to tool 350. The packers 358 may assume essentially any suitable construction or configuration, to facilitate aligning or shifting the tool 350 within wellbore 302. An illustrative working example is shown in FIG. 3 wherein, for each packer 358, an extendable arm portion is mounted at the tool 350 while a pad portion attached thereto may contact the inner surface of wellbore 302.

In accordance with one or more embodiments, via the rotational joints 356, each of the segments 354 may rotate about axis A such that a pre-perforated spear 352 may be oriented in any predetermined radial direction with respect to axis A.

Figure 4A:
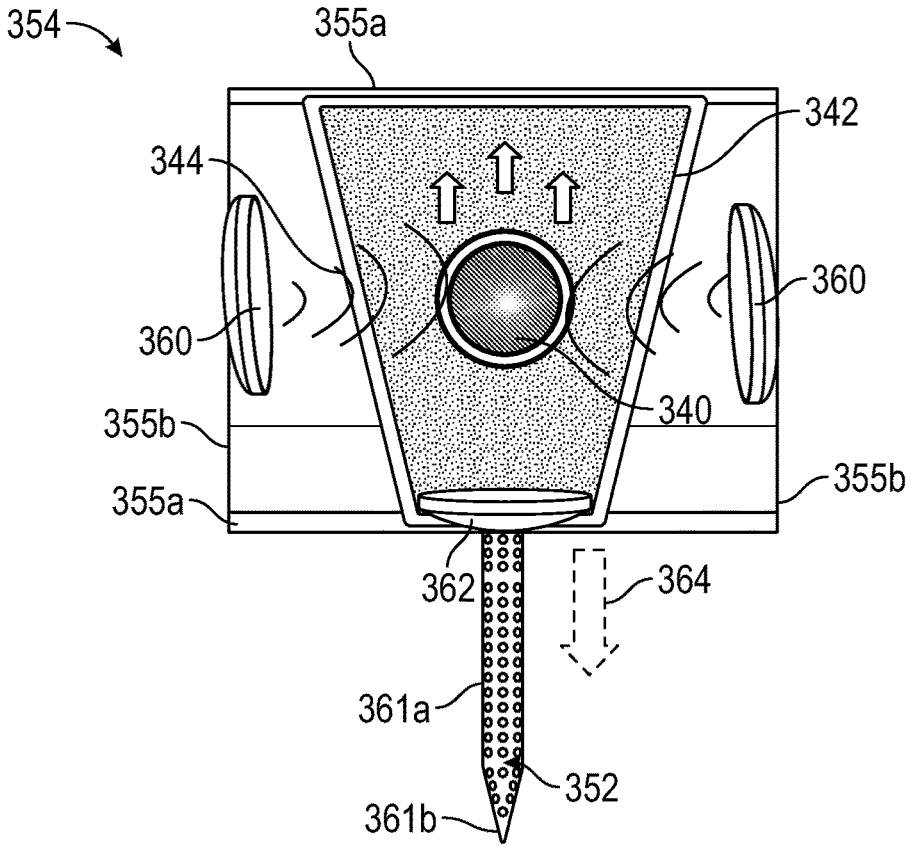
FIG. 4A schematically illustrates, in a cut-away elevational view, one of the segments from the tool in FIG. 3, in accordance with one or more embodiments.

In accordance with one or more embodiments, FIG. 4A shows one of the segments 354 from FIG. 3 in a cut-away elevational view, including a single pre-perforated spear 352. Segment 354 includes an outer wall defined by a circumferential portion 355*a* (e.g., cylindrical in shape) and end portions 355*b* (e.g., each being generally disc-shaped and disposed at a respective axial end of circumferential portion 355*a*). One or more acoustic transducers 360 may be disposed in each of the end portions 355*b*. Each transducer 360 transmits acoustic waves 344 through fluid environment 342 to cause an acoustic bubble 340 to expand and then collapse as discussed above, e.g., via a continuous transmission of acoustic waves 344 or via different transmissions.

In accordance with one or more embodiments, and with joint reference to both FIGS. 3 and 4A, transducers 360 may be electrically powered and controlled from the surface. They may also be controlled separately or collectively with respect to each segment 354; that is, they may be controlled differently for each segment 354 of tool 350 or may be controlled in concert with other transducers 360 in other segments 354. Such control may be determined with respect to characteristics of the formation 326. For instance, if the formation 326 is homogenous, where there is little to no variation in its lithology throughout at least a target zone for the tool 350 in wellbore 302, the transducers 360 can be controlled collectively across segments 354. If indeed there is marked variation in lithology in formation 326, throughout at least a target zone for the tool 350 in wellbore 302, then transducers 360 can be controlled differently from one segment 354 to another.

As shown, in accordance with one or more embodiments, a pre-perforated spear 352 is mounted at outer wall circumferential portion 355*a*. Spear 352 may be include a main body portion 361*a* and a tapered portion 361*b*. Main body portion 361*a* may be embodied as a tubular conduit of generally cylindrical shape, and tapered portion 361*b* may extend from a distal end of main body portion 361*a* and taper to a point as shown. Both main body portion 361*a* and tapered portion 361*b* may be embodied essentially as hollow members with perforations (or holes or orifices) disposed through respective outer wall portions thereof. For the purposes of illustration, the perforations are depicted as white dots on spear 352 but it should be understood that they may be embodied by essentially any suitable form, shape or array. Functionally, when the pre-perforated spear 352 is ejected from a wellbore into a formation, the perforations are configured to permit a flow of hydrocarbon between the formation and the wellbore.

In accordance with one or more embodiments, a rupture disk 362 is interposed between the inner volume (defined within outer wall 355*a/b*) and pre-perforated spear 352. Rupture disk 362 is configured to rupture responsive to pressure resulting from the induced sonoluminescence discussed above, and permit the ejection of the pre-perforated spear 352 away from the outer wall circumferential portion 355*b*. More particularly, rupture disk 362 is configured to rupture at a predetermined threshold pressure. Accordingly, the threshold pressure is chosen such that the pressure generated via the induced sonoluminescence will be more than sufficient to rupture the disk 362 and to cause the pre-perforated spear 352 to be ejected radially away from the segment 354, in direction 364, and into the formation 326.

In accordance with one or more embodiments, various parameters such as properties of the acoustic waves 344, the rupture disk 362 and the inner volume defined within outer wall 355*a/b* can be tailored or calibrated to ensure that sufficient pressure is generated to lodge the spear 352 in the formation 326 to a degree which permits hydrocarbon recovery through the spear 352. Such parameters can be determined, for instance, via empirical data obtained from experimentation and evaluating such data in a matrix.

In accordance with one or more embodiments, segment 354 is formed from a very strong material with a very high pressure rating, e.g., over 15,000 psi. Thus, segment 354 may be formed as a reinforced fluid container. Any of a great variety of materials may be used for the purpose, e.g., titanium or a stronger steel, with the thickness suitably tailored to withstand the very high pressures generated therewithin. Additionally, fluid environment 342 (in an inner volume defined within outer wall 355*a/b*) may be embodied by a mixture of water and air sufficient for promoting the creation of acoustic bubble 340.

Figure 4B:
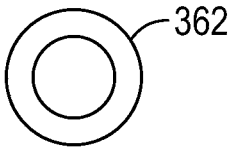
FIG. 4B schematically illustrates, in plan view, the rupture disk from FIG. 4A, in accordance with one or more embodiments.

In accordance with one or more embodiments, FIG. 4B schematically illustrates, in plan view, the rupture disk 362 from FIG. 4A. The rupture disk 362 may be formed from any suitable material such as carbon steel, stainless steel, graphite or a high-performance alloy. Parameters such as the material and its thickness may be tailored to help establish the threshold pressure discussed above.

Figure 5:
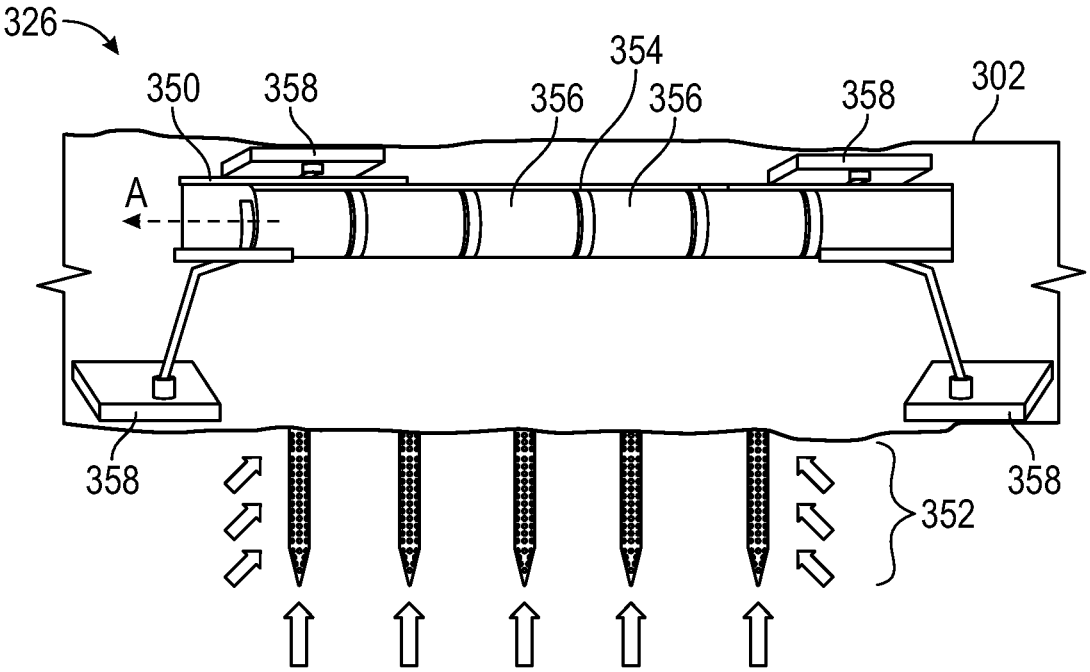
FIG. 5 provides essentially the same view as FIG. 3 but shows a subsequent operational stage, in accordance with one or more embodiments.

In accordance with one or more embodiments, it will be appreciated that FIG. 3 shows an operational stage of tool 350 where the pre-perforated spears 352 are initially mounted at the tool 350. For its part, FIG. 5 provides essentially the same view as FIG. 3 but shows a subsequent operational stage. Particularly, in FIG. 5 the spears 352 have been ejected as discussed above, and driven through the inner surface of wellbore 302 and into the surrounding formation 326. Hydrocarbon flow from formation 326 may then commence, as depicted by the arrows, into the holes in the pre-perforated spears 352 and into the wellbore 302.

By way of advantages in accordance with one or more embodiments, the use of acoustic bubbles and sonoluminescence avoid functional issues that may be encountered with other conceivable alternatives. For instance, chemicals potentially could react and generate pressure sufficient for ejecting pre-perforated spears 352 toward and into formation 326. However, this may present serious risks for contamination and the reactions may otherwise be difficult to control. The use of heat and combustible gas may also be contemplated, where the gas sufficiently expands in a chamber to generate enough pressure for the pre-perforated spears 352 to eject. However, this also may be difficult to control and similarly may present serious risks of contamination or structural damage.

Figure 6:
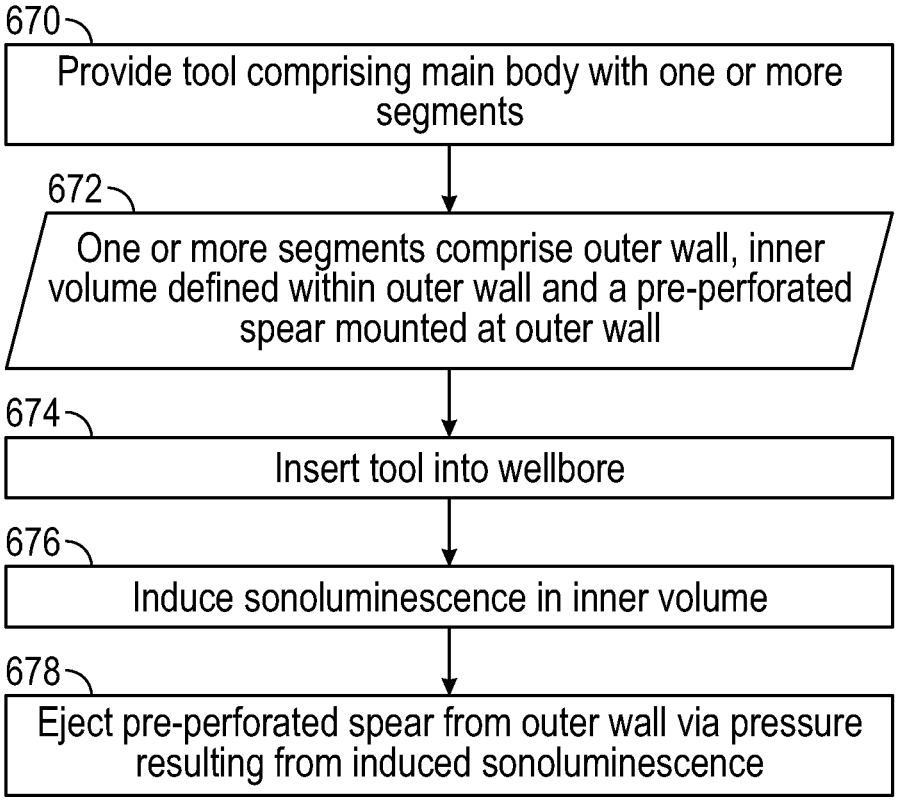
FIG. 6 illustrates a flowchart of a method in accordance with one or more embodiments.

FIG. 6 shows a flowchart of a method, as a general overview of steps which may be carried out in accordance with one or more embodiments described or contemplated herein.

As such, in accordance with one or more embodiments, a tool is provided (670) comprising a main body with one or more segments comprising (672): an outer wall; an inner volume defined within the outer wall; and a pre-perforated spear mounted at the outer wall. This can correspond to the tool 350 and segments 354 described and illustrated with respect to FIGS. 3 and 4A-4B. The tool is inserted into a wellbore (674), and sonoluminescence is induced in the inner volume (676). This can correspond to the related steps described and illustrated with respect to FIGS. 3 and 4A-4B. The pre-perforated spear is ejected from the outer wall via pressure resulting from the induced sonoluminescence (678). This can correspond to the related step described and illustrated with respect to FIGS. 4A-4B and 5.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A tool comprising:
a main body including one or more segments;
each of the one or more segments comprising:
an outer wall;
an inner volume defined within the outer wall; and
a pre-perforated spear mounted at the outer wall; and
one or more acoustic transducers which induce sonoluminescence in the inner volume,
wherein pressure resulting from the induced sonoluminescence causes the pre-perforated spear to be ejected from the outer wall.

2. The tool according to claim 1, comprising a fluid environment disposed in the inner volume.

3. The tool according to claim 2, wherein the one or more acoustic transducers induce the sonoluminescence via transmitting acoustic waves which expand and collapse an acoustic bubble in the fluid environment.

4. The tool according to claim 2, wherein the fluid environment comprises a mixture of water and air.

5. The tool according to claim 1, wherein the one or more segments comprise a plurality of segments disposed in series along a longitudinal axis of the tool.

6. The tool according to claim 5, wherein:
the one or more acoustic transducers comprise a plurality of acoustic transducers; and
each of the segments includes one or more of the plurality of acoustic transducers.

7. The tool according to claim 5, wherein each of the one or more segments is rotationally displaceable with respect to an adjacent one of the one or more segments.

8. The tool according to claim 5, wherein:
each of the segments comprises a rupture disk; and
the rupture disk is interposed between the inner volume and the pre-perforated spear.

9. The tool according to claim 8, wherein the rupture disk is configured to:
rupture responsive to the pressure resulting from the induced sonoluminescence; and
permit the ejection of the pre-perforated spear away from the outer wall.

10. The tool according to claim 1, further comprising one or more expandable packers configured to shift a position of the tool within a wellbore.

11. The tool according to claim 1, wherein:
the pre-perforated spear comprises a tubular main body with perforations disposed therein,
wherein, when the pre-perforated spear is ejected from a wellbore into a formation, the perforations are configured to permit a flow of hydrocarbon between the formation and the wellbore.

12. A method comprising:
providing a tool comprising a main body with one or more segments comprising:
an outer wall;
an inner volume defined within the outer wall; and
a pre-perforated spear mounted at the outer wall;
inserting the tool into a wellbore;
inducing sonoluminescence in the inner volume; and
ejecting the pre-perforated spear from the outer wall via pressure resulting from the induced sonoluminescence.

13. The method according to claim 12, wherein the sonoluminescence is induced via one or more acoustic transducers of the tool.

14. The method according to claim 13, wherein:
inducing the sonoluminescence comprises transmitting acoustic waves via the one or more acoustic transducers,
wherein the acoustic waves which expand and collapse an acoustic bubble in a fluid environment disposed in the inner volume.

15. The method according to claim 13, wherein:
the one or more segments comprise a plurality of segments disposed in series along a longitudinal axis of the tool;
the one or more acoustic transducers comprise a plurality of acoustic transducers; and
each of the segments includes one or more of the plurality of acoustic transducers.

16. The method according to claim 15, wherein each of the one or more segments is rotationally displaceable with respect to an adjacent one of the one or more segments.

17. The method according to claim 15, wherein:
each of the segments comprises a rupture disk interposed between the inner volume and the pre-perforated spear, wherein the pre-perforated spear is ejected from the outer wall when the rupture disk ruptures responsive to the pressure resulting from the induced sonoluminescence.

18. The method according to claim 12, further comprising shifting a position of the tool within the wellbore via one or more expandable packers.

19. The method according to claim 12, wherein ejecting the pre-perforated spear comprises ejecting the pre-perforated spear from the wellbore into a formation.

20. The method according to claim 19, further comprising permitting a flow of hydrocarbon between the formation and the wellbore via perforations disposed in the pre-perforated spear.

* * * * *